US006846108B2

(12) United States Patent
Buchman

(10) Patent No.: US 6,846,108 B2
(45) **Date of Patent: *Jan. 25, 2005**

(54) RESEALABLE PACKAGE HAVING ZIPPER CLOSURE INCLUDING A SLIDER DEVICE AND RETAINING NOTCH

(75) Inventor: James E. Buchman, Hortonville, WI (US)

(73) Assignee: Reynolds Consumer Products, Inc., Richmond, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/223,717

(22) Filed: Aug. 20, 2002

(65) Prior Publication Data

US 2004/0037477 A1 Feb. 26, 2004

(51) Int. Cl.[7] ..... B65D 33/16
(52) U.S. Cl. ..... 383/64; 24/399
(58) Field of Search ..... 383/64; 24/399, 24/400, 427

(56) References Cited

U.S. PATENT DOCUMENTS

| | | | | |
|---|---|---|---|---|
| 3,790,992 A | | 2/1974 | Herz | |
| 5,020,194 A | * | 6/1991 | Herrington et al. | 24/400 |
| 5,063,644 A | | 11/1991 | Herrington et al. | |
| 5,067,208 A | * | 11/1991 | Herrington et al. | 24/400 |
| 5,301,394 A | | 4/1994 | Richardson et al. | |
| 5,301,395 A | | 4/1994 | Richardson et al. | |
| 5,442,837 A | | 8/1995 | Morgan | |
| 5,664,329 A | | 9/1997 | Nickel | |
| 5,669,715 A | | 9/1997 | Dobreski et al. | |
| 5,722,128 A | | 3/1998 | Toney et al. | |
| 5,775,812 A | | 7/1998 | St. Phillips et al. | |
| 5,851,070 A | | 12/1998 | Dobreski et al. | |
| 5,871,281 A | | 2/1999 | Stolmeier et al. | |
| 5,919,535 A | | 7/1999 | Dobreski et al. | |
| 5,950,285 A | * | 9/1999 | Porchia et al. | 24/400 |
| 6,200,027 B1 | | 3/2001 | Jones | |
| 6,231,236 B1 | | 5/2001 | Tilman | |
| 6,247,843 B1 | | 6/2001 | Buchman | |
| 6,287,000 B1 | | 9/2001 | Buchman | |
| 6,287,001 B1 | | 9/2001 | Buchman | |
| 6,290,393 B1 | | 9/2001 | Tomic | |
| 6,293,701 B1 | | 9/2001 | Tomic | |
| 6,364,530 B1 | * | 4/2002 | Buchman | 383/64 |

FOREIGN PATENT DOCUMENTS

| | | |
|---|---|---|
| WO | 01/34487 A1 | 5/2001 |
| WO | WO 02/10028 A2 | 2/2002 |

* cited by examiner

*Primary Examiner*—Jes F. Pascua
(74) *Attorney, Agent, or Firm*—Eckert Seamans Cherin & Mellott, LLC

(57) ABSTRACT

A reclosable closure arrangement for use with packages, such as food and non-food packages, that includes a zipper closure having a slider device to open and close a pair of mating closure profiles. The slider device includes a plow member used to separate the closure profiles as the plow is moved along the length of the closure profile. Each of the closure profiles includes a receiving notch that defines a home position for the slider device. The receiving notches formed in the closure profile have a maximum length which is less than the length of a plow formed on the slider device. Thus, the slider device is prevented from becoming displaced from between the closure profiles.

11 Claims, 6 Drawing Sheets

RESEALABLE PACKAGE HAVING ZIPPER CLOSURE INCLUDING A SLIDER DEVICE AND RETAINING NOTCH

FIELD OF THE INVENTION

The present invention generally relates to a closure arrangement for resealable packages, such as plastic bags. More specifically, the present invention relates to a closure arrangement having reclosable profiles and a slider device to open and close the profiles.

BACKGROUND OF THE INVENTION

Many packaging applications use resealable containers to store various types of articles and materials. These packages may be used to store and ship food products, non-food consumer goods, medical supplies, waste materials, and various other types of articles. Resealable packages are convenient in that they can be closed and resealed after the initial opening to preserve the enclosed contents. The need to locate a storage container for the unused portion of the product in the package is thus avoided. As such, providing products in a resealable package appreciably enhances the marketability of these products.

Some types of resealable packages are opened and closed using a slider device. The slider device typically includes a separator or plow-type structure at one end that opens a zipper closure mechanism having profiled elements or closure profiles when the slider device travels in a first direction along the zipper closure. The sidewalls of the slider device are inwardly tapered from one end to the opposite end so that the sidewalls engage the closure profiles and progressively move them into engagement to close the resealable package when the slider device is moved along the zipper closure in a direction opposite to the first direction.

Resealable packages including a slider device to more easily open and close the profiles often include a notch formed in the closure profiles near one end of the zipper closure mechanism. The notch formed in the profile provides a "home" position for the slider when the package is in a completely closed position. The notch formed in the profile typically receives the plow formed in the slider such that the profile can be closed on each side of the plow to create a continuous seal across the entire package.

Although a notch formed in the mating profiles on the closed end of the resealable package is known, problems can occur during opening of the package. For example, if the profile elements and the slider device are twisted relative to each other before opening, the plow can be displaced from between the profiles such that the plow is ineffective in opening the zipper closure mechanism as the plow is drawn along the length of the zipper. This type of situation obviously renders the plow ineffective and reduces consumer confidence in the reliability of a zipper closure including a slider device.

Therefore, it is an object of the present invention to provide an improved zipper closure mechanism that has a receiving notch that prevents the plow of the slider device from becoming displaced during opening of the closure mechanism.

SUMMARY OF THE INVENTION

The present invention is directed to a combination slider device and zipper closure that closes the mouth of a flexible, reclosable package. The zipper closure includes a pair of aligned receiving notches that receive the slider to define a home position for the slider along the length of the zipper closure.

In accordance with the invention, the zipper closure includes a first closure profile and a second closure profile that engage each other to seal the zipper closure along the mouth of the product package. The slider device is positioned to move along the pair of closure profiles to engage and disengage the closure profiles as the slider device is moved.

The slider device includes a plow depending from its top surface that travels between a pair of upper flanges formed on the first and second closure profiles. The plow includes a pair of angled wedges that separate the upper flanges, thus causing the first and second closure profiles to separate, as the slider device is moved in a first direction. The plow formed on the slider device has a length defined along the direction of movement of the slider.

Each of the closure profiles includes an upper flange that extends from an interlocking profile. The interlocking profile of each closure profile allows the closure profiles to be matingly engaged with each other. The upper flange of the closure profile extends along the entire length of the closure profile.

Each closure profile of the present invention includes a receiving notch formed in the upper flange of the closure profile. The receiving notches of each closure profile are aligned with each other to provide a home position for the slider device. The home position for the slider device is a resting position for the slider device when the bag is in its completely closed position. When the slider device is in the home position, the zipper closure is sealed on each side of the slider device. In the preferred embodiment of the invention, the home position is near a side seal formed between the pair of closure profiles.

Each of the receiving notches formed in the closure profiles has a maximum length measured in the direction of the slider device movement. In the preferred embodiment of the invention, the maximum length of the receiving notches is formed along a top edge of the upper flange of each closure profile. In the preferred embodiment, each of the receiving notches has a V-shape.

In accordance with the present invention, the maximum length of each receiving notch is less than the length of the plow formed on the slider device. Thus, the plow of the slider device is prevented from becoming displaced from between the pair of upper flanges formed on the closure profile while allowing a seal along the length of the zipper closure. However, the length of the receiving notch must be sufficient to allow the plow to extend outward from the closure profiles such that the zipper closure is sealed on each side of the slider device.

DETAILED DESCRIPTION OF PREFERRED EMBODIMENTS

Flexible packages having zipper closures are common in today's packaging market. Typically, the zipper closure has a first and a second interlocking closure profile. The zipper closure provides easy opening and closing of the package mouth to gain access to the contents within the package interior. The addition of a slider device to a flexible package, such as a plastic bag, is advantageous to aging or arthritic persons not having the physical ability to use just a zipper closure to reseal a bag. Additionally, the use of a slider device with a flexible package facilitates the use of the bag by users of all ages and abilities.

Figure 1:
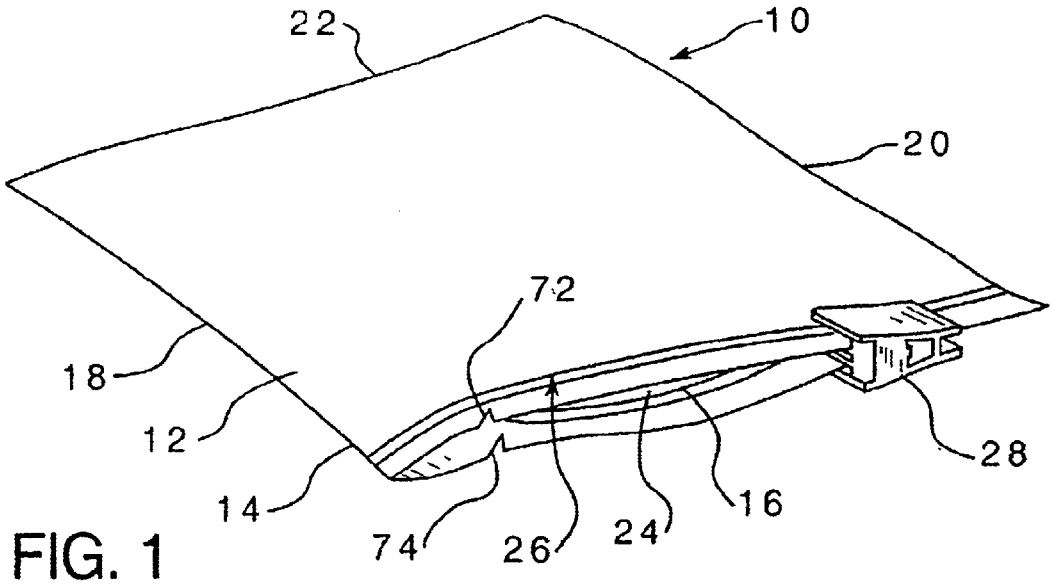
FIG. 1 is a perspective view of a flexible, reclosable package having a zipper closure and a slider device.

FIG. 1 illustrates a flexible, reclosable package 10. The flexible package 10 has a first and a second polymeric film side panels 12 and 14 defining an open interior 16. The flexible package 10 includes a pair of side edges 18 and 20 and a bottom edge 22. The pair of side panels 12 and 14 are connected to each other along the side edges 18 and 20 as the bottom edge 22 to form the open interior 16 of the package 10. The first side edge 18 and the second side edge 20 are formed by seals created by the application of heat and pressure for a set period to the side panels 12 and 14.

As shown in FIG. 1, a mouth 24 provides access to the interior 16 of the package 10 along the top of the package 10. A zipper closure 26 is formed along the mouth 24 and extends from the first side edge 18 to the second side edge 20. The zipper closure 26 can include a variety of configurations and structures.

A slider device is mounted on the zipper closure 26 to facilitate opening and closing of the zipper closure 26. The slider device 28 and its function to open and close the zipper closure 26, in general, are taught in U.S. Pat. Nos. 5,0633,644; 5,301,394; and 5,442,837, each of which are incorporated herein by reference.

Figure 2:
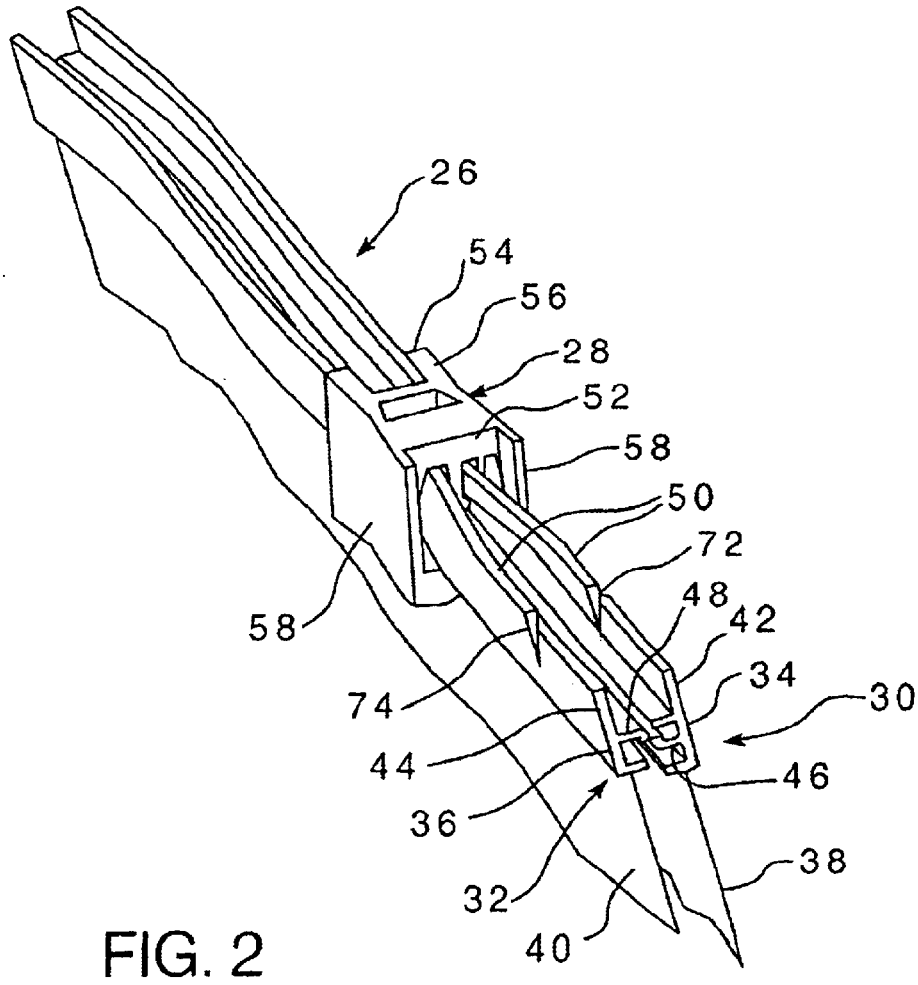
FIG. 2 is a partial perspective view illustrating the slider device disposed upon the zipper closure and a pair of receiving notches formed in the zipper closure to provide a home position for the slider device.

Referring now to FIG. 2, thereshown is the zipper closure 26 utilized in the present invention. Although a specific embodiment of the zipper closure 26 is shown in FIG. 2, it should be understood that various other configurations for the zipper closure 26 could be used while falling within the scope of the present invention.

The zipper closure 26 has a first closure profile 30 and a second closure profile 32. Specifically, the first closure profile 30 has a first interlocking profile 34 and the second closure profile 32 has a second interlocking profile 36. The first and second interlocking profiles 34 and 36 are arranged and constructed to interlock and provide a seal across the mouth of the package.

The first and second closure profiles 30 and 32 include first and second sealing flanges 38 and 40 that are used to secure the closure profiles 30 and 32 to the respective side panels of the reclosable package. The first closure profile 30 includes a first upper flange 42 while the second closure profile 32 includes a similar second upper flange 44.

As illustrated in FIG. 2, the first closure profile 30 includes a closure post 46 that receives and engages a second closure post 48 to create an interlocking seal between the pair of closure profiles 30 and 32.

As can be seen in FIG. 2, the slider device 28 of the present invention is mounted to the first and second closure profiles 30 and 32 and rests upon the top edge 50 of each of the upper flanges 42 and 44. The slider device 28 extends between a first end 52 and a second end 54. The slider device includes a top surface 56 and a pair of depending sidewalls 58 that act as a grasping section for movement of the slider along the length of the first and second closure profiles 30 and 32.

Figure 3A:
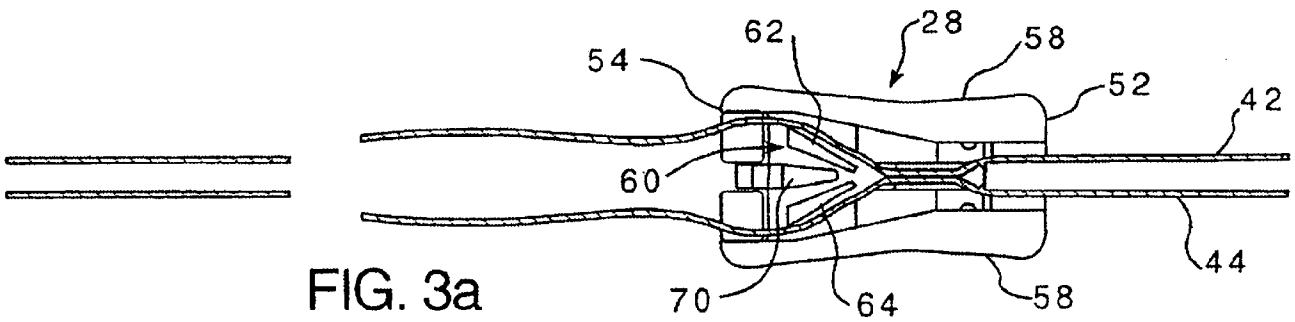
FIG. 3*a* is a top view illustrating the interaction between the slider device and the zipper closure.
Figure 3B:
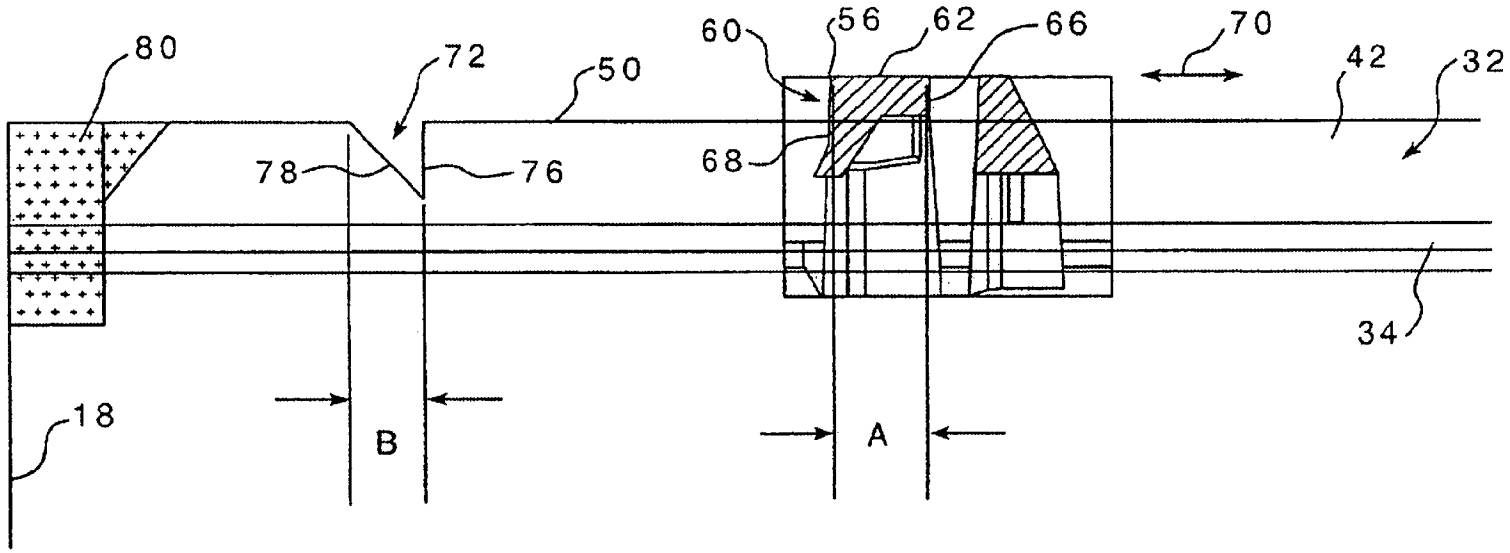
FIG. 3*b* is a side view of the slider device positioned along the zipper closure.

Referring now to FIGS. 3*a* and 3*b*, the slider device 28 includes a spreader device or plow 60 that projects downward from the top surface 56 of the slider device. In the embodiment of the invention illustrated, the plow 60 includes a pair of divergent angled wedges 62, 64.

During use of the slider device 28, the angled wedges 62, 64 separate the upper flange 42 of the first closure profile from the upper flange 44 of the second closure profile as the slider device 28 is moved to the right when viewed in FIG. 3*a*.

As can be seen in FIG. 3*b*, each of the angled wedges 62, 64 of the plow 60 only extend between the upper flanges 42, 44 of the closure profiles 30, 32 and do not penetrate into the interlocking profile members 34, 36. This feature of the plow helps to insure a leak-proof closure mechanism.

As can be seen in FIG. 3*b*, each of the angled wedge 62 extends from a first edge 66 to a second edge 68 such that the length of the wedge, in the direction of slider movement illustrated by arrow 70, is illustrated by length A—A. In the preferred embodiment of the invention, the length of the plow 60, as illustrated by length A—A, is approximately 0.19 inches. This dimension is given for illustrative purposes only and should not be deemed as a feature of the invention, since the dimensions of the slider device 28 can vary depending upon the type of package upon which it is used.

As can be seen in FIG. 3*a*, the slider device 28 also includes a center wedge 70 that is positioned between the pair of angled wedges 60 and 64. The center wedge 70 aids in directing the upper flanges 42, 44 after the slider device 28 has been moved past its home position, as will be discussed in greater detail below.

Referring back to FIG. 2, the upper flange 42 of the first closure profile 30 includes a receiving notch 72 and the upper flange 44 of the second closure profile 32 includes a corresponding receiving notch 74. As illustrated in FIG. 2, the receiving notches 72 and 74 are aligned with each other along the longitudinal length of the first and second closure profiles 30 and 32.

Referring now to FIG. 3*b*, the upper flange 42 of the first closure profile 30 includes a receiving notch 72 formed near the side edge 18. Although not shown, the receiving notch 74 formed in the opposite profile 32 is identical to the notch 72. The receiving notch 72 is formed in only the upper flange 42 and does not extend downward into the interlocking profile 34 such that the receiving notch 72 does not affect the interlocking closure between the first closure profile 30 and the second closure profile 32.

In the preferred embodiment of the invention illustrated in FIG. 3*b*, the receiving notch 72 has a generally V-shaped profile and is formed from a first edge surface 76 that extends perpendicular to the top edge 50 of the upper flange 42. The receiving notch 72 further includes an angled edge surface 78 that extends from the bottom of the first edge surface 76 upward to the top edge 50. As illustrated in FIG. 3*b*, the maximum length of the receiving notch 72 as measured along the direction of slider movement illustrated arrow 70 is along the top edge 50 of the upper flange 42 and is illustrated by distance B—B. Although the length of the receiving notch 72 decreases from the top edge 50 to the intersection between the angled edge surface 78 and 76, the length of the receiving notch 72 at its maximum width is an important design feature of the receiving notch 72. In the embodiment of the invention illustrated in FIG. 3*b*, the maximum width B—B of the receiving notch 72 is 0.1549 inches, although the actual value of the length B—B can vary depending upon the type of package being utilized.

Although a V-shaped receiving notch 72 is shown in the preferred embodiment of the invention, it should be understood that various other configurations for the receiving notch 72 are contemplated as being within the scope of the invention. For example, a rectangular notch and a V-shaped notch in which both of the edge surfaces are angled relative to the top edge 50 are contemplated as being within the scope of the present invention. Regardless of the actual shape of the notch, the maximum width of the notch formed in the upper flange 42 is an important aspect of the present invention.

As illustrated in FIG. 3*b*, a side seal 80 is formed between the first and second closure profiles 30, 32 to provide a water-tight seal along the side edge 18. Although not illustrated in FIG. 3*b*, a similar side seal is formed along the opposite side edge 20.

Figure 4A:
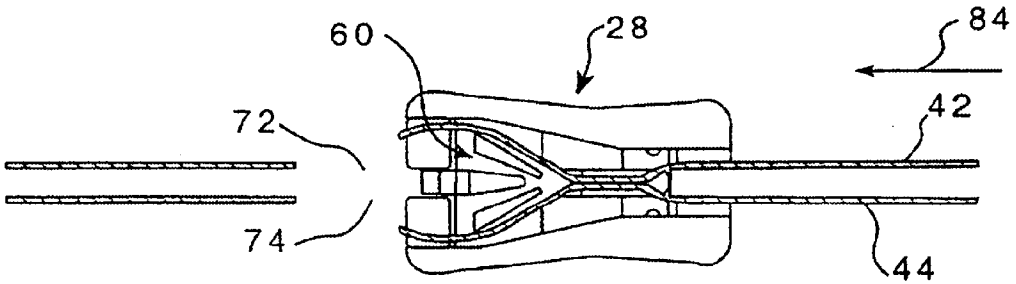
FIG. 4*a* is a top view of the slider device as the slider device approaches the pair of receiving notches formed in the zipper closure.
Figure 4B:
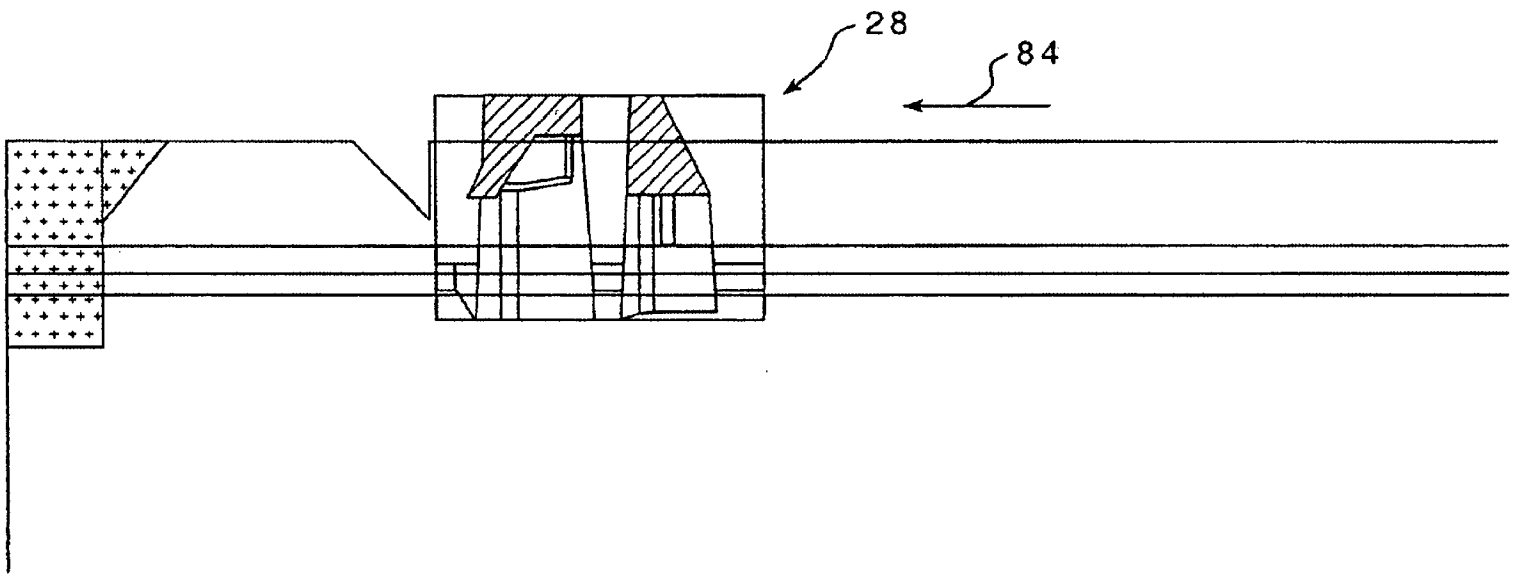
FIG. 4*b* is a side view of the slider device as the slider device approaches the pair of receiving notches.

Referring now to FIGS. 4*a* and 4*b*, as the slider device 28 is moved in the direction shown by arrow 84, the slider device 28 approaches the pair of receiving notches 72, 74 formed in the respective upper flanges 42 and 44. As illustrated, the plow 60 initially separates the upper flanges 42 and 44 as the plow 60 approaches the pair of receiving notches 72 and 74 while the remaining portions of the slider interlock the mating profiles as is known.

Figure 5A:
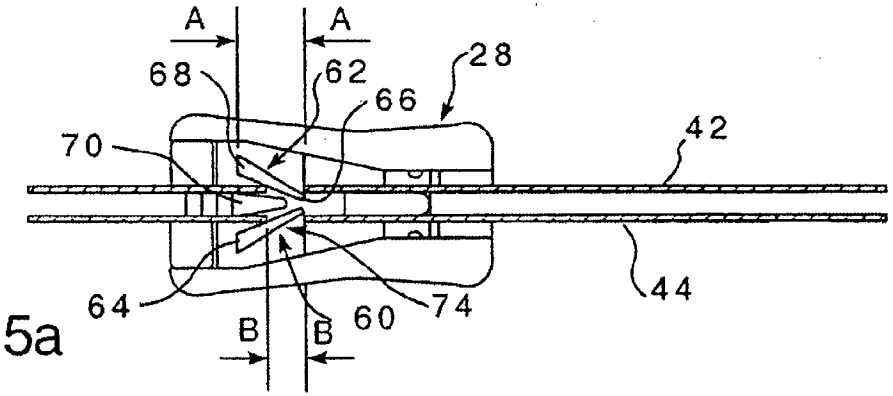
FIG. 5*a* is a top view of the slider device as the plow of the slider device is received within the pair of receiving notches formed in the zipper closure.
Figure 5B:
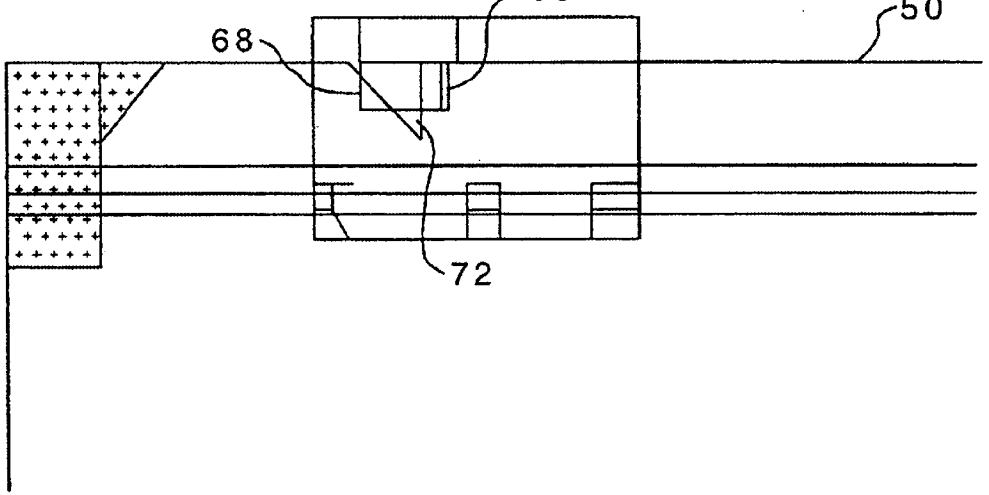
FIG. 5*b* is a side view similar to FIG. 5*a;*

Referring now to FIG. 5*a*, thereshown is an illustration of the position of the plow 60 within the gap created by the pair of receiving notches 72 and 74. As the plow 60 approaches the pair of notches 72 and 74, the second end 68 of each angled wedge 62 and 64 extends through the respective notch 72 or 74 such that the seal between the profiles remains below the plow 60. As illustrated, the second ends 68 of the angled wedges 62 and 64 pass to the outside of the upper flanges 42 and 44 such that the plow 60 does not separate the upper flanges 42 and 44 as the slider moves past the notches 72 and 74.

As clearly illustrated in FIG. 5*a*, the length of the plow A—A from the first edge 66 to the second edge 68 of each of the angled wedges 62, 64 is greater than the maximum length B—B of each of the receiving notches 72, 74. As can be understood in FIG. 5*a*, when the slider device 28 is in the position illustrated, the center wedge 70 is between the upper flanges 42 and 44 past the notches 72 and 74 and the length A—A of the slider 60 prevents the entire plow 60 from becoming displaced from between the pair of upper flanges 42, 44 and being positioned completely to the outside of one of the upper flanges 42, 44.

In prior systems, the length of the receiving notches was greater than the length of the plow, such that the plow could become disengaged with the pair of upper flanges 42, 44. In the prior art system, when the plow became disengaged, the entire plow would pass to the outside of either of the upper flanges such that the plow, and thus the slider device would be ineffective in opening the zipper closure during further movement of the slider device.

In accordance with the present invention, the plow 60 has an overall length A—A which is greater than the maximum length B—B of the receiving notches 72, 74 such that the plow 60 cannot become disengaged from between the pair of upper flanges 42, 44.

Figure 6A:
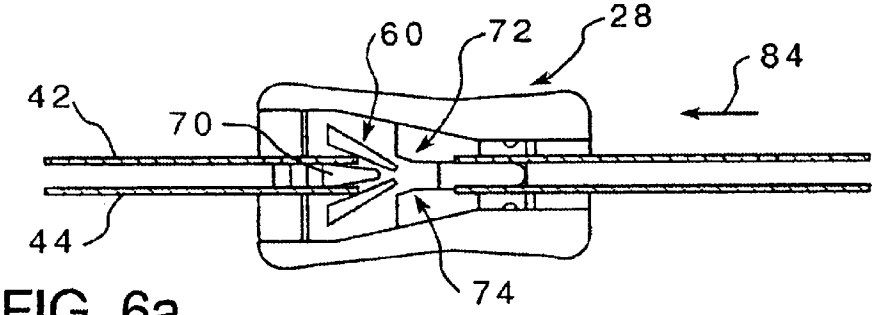
FIG. 6*a* is a top view illustrating the movement of the slider device past the receiving notches.
Figure 6B:
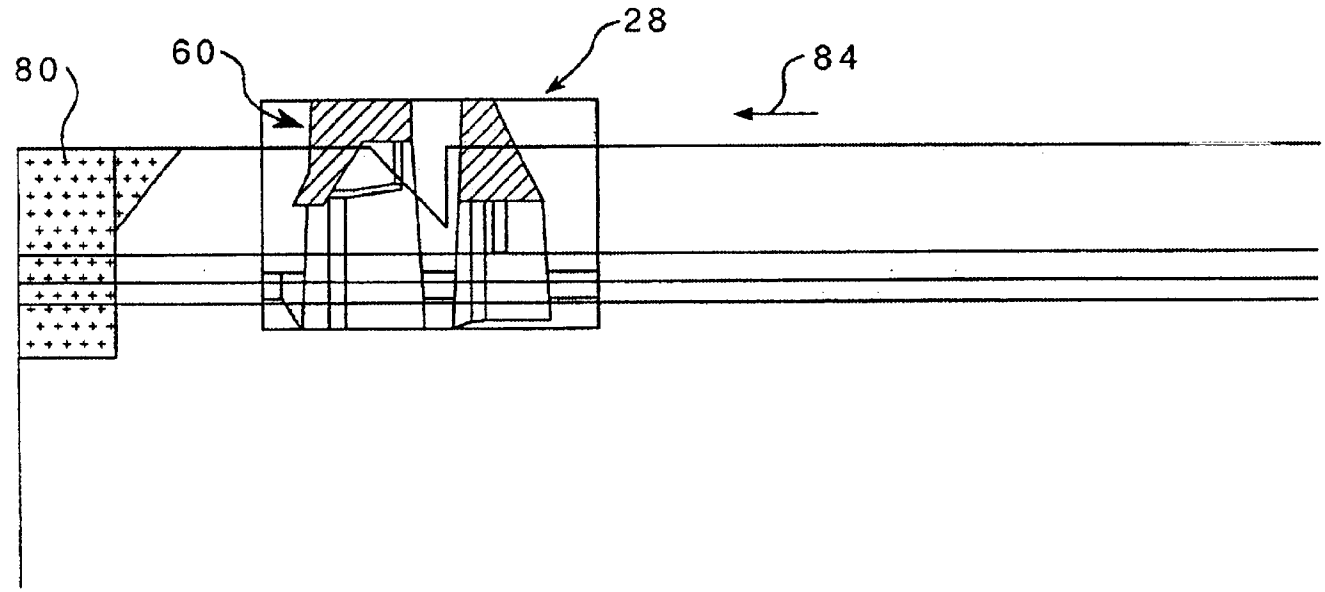
FIG. 6*b* is a side view similar to FIG. 6*a;*
Figure 7A:
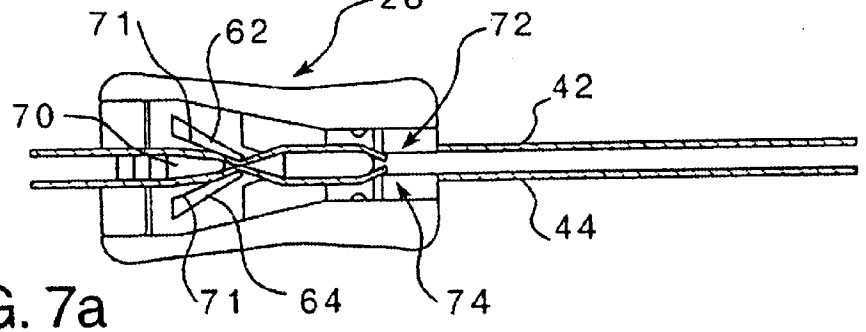
FIG. 7*a* is a top view illustrating the movement of the slider device further of receiving notches.
Figure 7B:
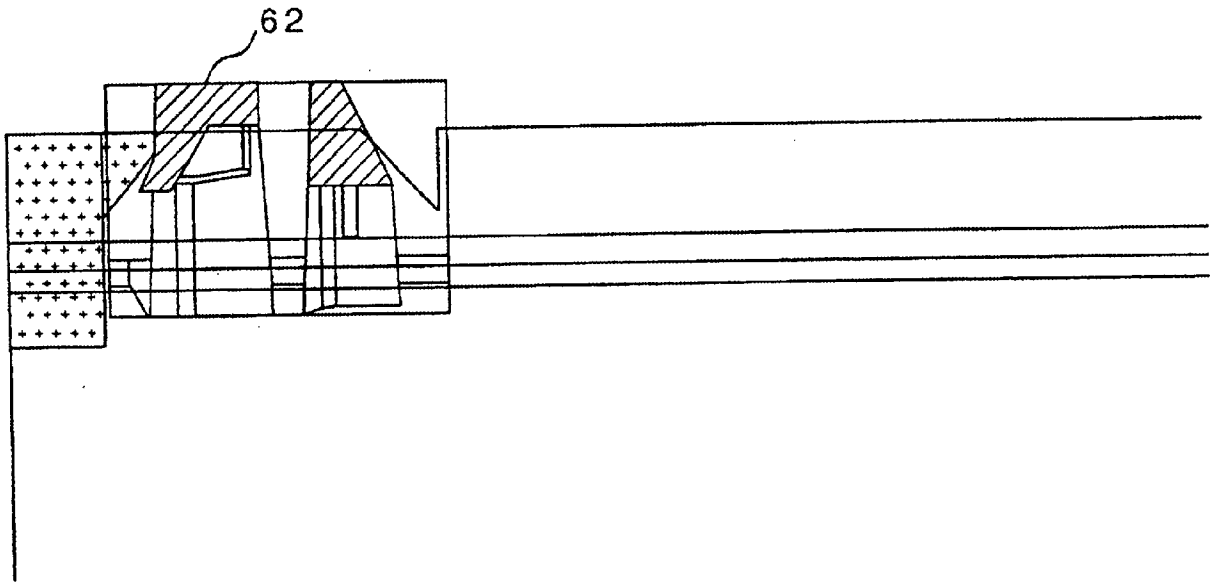
FIG. 7*b* is a view similar to FIG. 7*a*.

FIGS. 6*a* and 6*b* illustrate the movement of the slider device 28 further toward the side seal 80. As the slider device 28 moves closer to the side seal 80, the plow 60 moves past the pair of receiving notches 72 and 74. As the slider device moves in the direction illustrated by arrow 84, the center wedge 70 stays between the upper flanges 42 and 44 until the upper flanges are directed together by the inner surface 71 formed on each of the pair of angled wedges 62, 64, as illustrated in FIG. 7*a*.

When a user desires to open the reclosable package, the slider device 28 is moved to the right, as illustrated in FIG. 5*a*. As the slider device is moved to the right, the leading edge 68 of each angled wedge 62, 64 passes between the upper flanges 42, 44 to begin separating the upper flanges 42, 44 in a known manner. Since the length of the plow 60 is greater than the maximum length of the receiving notches 72, 74, the plow 60 is prevented from becoming displaced from between the pair of upper flanges 42 and 44. Thus, the dimensions of the plow 60 relative to the receiving notches 72, 74 prevent displacement of the plow and aids in insuring proper operation of the slider device 28.

Having described the presently preferred embodiments, it is to be understood that the invention may be otherwise embodied within the scope of the appended claims.

What is claimed is:

1. A flexible, reclosable package comprising:

a pair of side panels joined along a first side edge and a second side edge, the panels defining a mouth providing access to a package interior;

a reclosable zipper positioned along the mouth of the package for selectively opening and closing the package mouth, the zipper including a first closure profile and a second closure profile each constructed and arranged to interlock each other to hold the mouth in a closed position;

a slider device operatively mounted on the zipper, the slider device being configured to interlock the first closure profile with the second closure profile when the slider device is moved in the first direction and disengage the first closure profile from the second closure profile when the slider device is moved in a second, opposite direction, wherein the slider device includes a plow configured to separate the first closure profile from the second closure profile when the slider device is moved in the second, opposite direction, the plow having a length; and a pair of aligned receiving notches formed in the first closure profile and the second closure profile, respectively, to receive and retain the plow of the slider device when the slider device is in a home position, each of the receiving notches having a maximum length that is less than the length of the plow formed on the slider device, each of the notches including a first edge generally perpendicular to the first and second direction of movements of the slider device, and a second edge extending at an acute angle to the first edge, the second edge of the notch being disposed between the first edge of the notch and the side edge of the reclosable package nearest the notch.

2. The flexible package of claim 1 wherein the first closure profile and the second closure profile each include an upper flange, wherein the notch formed in each of the first and second closure profiles is formed in the upper flange of the respective profile.

3. The flexible package of claim 1 wherein the second edge is joined to the first edge.

4. The flexible package of claim 1 wherein the plow formed on the slider device includes a first angled wedge and a second angled wedge, each of the angled wedges extending from a first edge to a second edge, wherein the angled wedges diverge from each other from the first edge to the second edge.

5. The flexible package of claim 4 wherein the length of each angled wedge from the first edge to the second edge is greater than the maximum length of the receiving notches.

6. The flexible package of claim 5 wherein the plow further includes a center wedge positioned between the first and second angle wedges, the center wedge being configured to be received between the first closure profile and the second closure profile as the slider device is moved past the pair of receiving notches.

7. A flexible, reclosable package comprising:

a pair of side panels joined along a first side edge and a second side edge, the panels defining a mouth providing access to a package interior;

a reclosable zipper positioned along the mouth of the package for selectively opening and closing the package mouth, the zipper including a firs closure profile and a second closure profile each constructed and arranged to interlock each other to hold the mouth in a closed position;

a slider device operatively mounted on the zipper, the slider device being configured to interlock the first closure profile with the second closure profile when the slider device is moved in the first direction and disengage the first closure profile from the second closure profile when the slider device is moved in a second, opposite direction, wherein the slider device includes a plow positioned between an upper flange formed on the first closure profile and an upper flange formed on the second closure profile, the plow being configured to separate the first closure profile from the second closure profile when the slider device is moved in the second, opposite direction, the plow having a length measured along the first direction; and a pair of aligned receiving notches formed in the upper flanges of the first closure profile and the second closure profile, respectively, the receiving notches being formed to allow the plow of the slider device to extend outward past the upper flanges of the first and second closure profiles when the slider device is in a home position, each of the receiving notches having a maximum length measured in the first direction that is less than the length of the plow formed on the slider device to prevent the plow from becoming displaced from between the upper flanges of the first closure profile and the second closure profile each of the notches including a first edge generally perpendicular to the first and second direction of movements of the slider device, and a second edge extending at an acute angle to the first edge, the second edge of the notch being disposed between the first edge of the notch and the side edge of the reclosable package nearest the notch.

8. The flexible package of claim 7 wherein the second edge is joined to the first edge.

9. The flexible package of claim 7 wherein the plow formed on the slider device includes a first angled wedge and a second angled wedge, each of the angled wedges extending from a first edge to a second edge, wherein the angled wedges diverge from each other from the first edge to the second edge.

10. The flexible package of claim 9 wherein the length of each angled wedge from the first edge to the second edge is greater than the maximum length of the receiving notches.

11. The flexible package of claim 10 wherein the plow further includes a center wedge positioned between the first and second angle wedges, the center wedge being configured to be received between the first closure profile and the second closure profile as the slider device is moved past the pair of receiving notches.

* * * * *

UNITED STATES PATENT AND TRADEMARK OFFICE

CERTIFICATE OF CORRECTION

PATENT NO. : 6,846,108 B2
DATED : January 25, 2005
INVENTOR(S) : James E. Buchman It is certified that error appears in the above-identified patent and that said Letters Patent is hereby corrected as shown below:

Column 3,
Line 11, after "further", insert -- past the pair --.
Line 33, after "20", insert -- as well --.
Line 44, after "device" insert -- 28 --.

Column 7,
Line 31, "firs" should read -- first --.

Signed and Sealed this

Third Day of May, 2005

JON W. DUDAS
*Director of the United States Patent and Trademark Office*